US006880737B2

(12) United States Patent
Bauer

(10) Patent No.: US 6,880,737 B2
(45) Date of Patent: Apr. 19, 2005

(54) CELL PHONE HOLSTER SUBSIDIARY STRAP AND HOLDER

(76) Inventor: Edward Bauer, P.O. Box 19-0396, Brooklyn, NY (US) 11219

( * ) Notice: Subject to any disclaimer, the term of this patent is extended or adjusted under 35 U.S.C. 154(b) by 23 days.

(21) Appl. No.: 10/281,002

(22) Filed: Oct. 25, 2002

(65) Prior Publication Data

US 2004/0079776 A1 Apr. 29, 2004

(51) Int. Cl.[7] ..... B65D 25/10

(52) U.S. Cl. ..... 224/246; 224/250; 224/269; 224/901.4; 224/930

(58) Field of Search ..... 224/246, 250, 224/269, 901.4, 930

(56) References Cited

U.S. PATENT DOCUMENTS

| | | | | |
|---|---|---|---|---|
| 2,567,602 | A | | 9/1951 | Higgins |
| 4,479,596 | A | | 10/1984 | Swanson |
| 4,771,927 | A | | 9/1988 | Ventura |
| 4,800,592 | A | * | 1/1989 | Cable ..... 2/69 |
| 4,951,817 | A | | 8/1990 | Barletta et al. |
| 5,009,346 | A | * | 4/1991 | Butler ..... 224/605 |
| 5,064,109 | A | * | 11/1991 | Caster ..... 224/267 |
| D329,750 | S | | 9/1992 | Gilmore et al. |
| D329,945 | S | | 10/1992 | Benskin |
| 5,217,294 | A | | 6/1993 | Liston |
| 5,503,316 | A | | 4/1996 | Stewart |
| D371,137 | S | | 6/1996 | Kriegh |
| 5,535,928 | A | | 7/1996 | Herring |
| D373,241 | S | | 9/1996 | Chavez et al. |
| D374,768 | S | | 10/1996 | Lundie, Jr. |
| D377,117 | S | | 1/1997 | Klassen |
| D389,641 | S | | 1/1998 | McCutcheon et al. |
| D398,777 | S | | 9/1998 | Epstein |
| 5,816,459 | A | | 10/1998 | Armistead |
| D406,695 | S | | 3/1999 | Nagele et al. |
| D419,290 | S | | 1/2000 | Treyer et al. |
| D420,506 | S | | 2/2000 | Merritt |
| 6,081,695 | A | | 6/2000 | Wallace et al. |
| D437,111 | S | | 2/2001 | Bergh |

* cited by examiner

*Primary Examiner*—Stephen K. Cronin
(74) *Attorney, Agent, or Firm*—Abelman, Frayne & Schwab

(57) ABSTRACT

A holder retains cell phones, pagers, or holsters, with the holder composed of fabric; having a strap and optionally a pouch for retaining the held cell phones, pagers, or holsters in any angular orientation of the holder; and having a pair of apertures for engaging and retaining the clip of an associated cell phone, pager, or holster, with a strip positioned between the pair of apertures for engaging the clip and for distributing the weight and/or other forces associated with the clip and the associated cell phone, pager, or holster and preventing wear on the holder.

20 Claims, 5 Drawing Sheets

FIG. 3
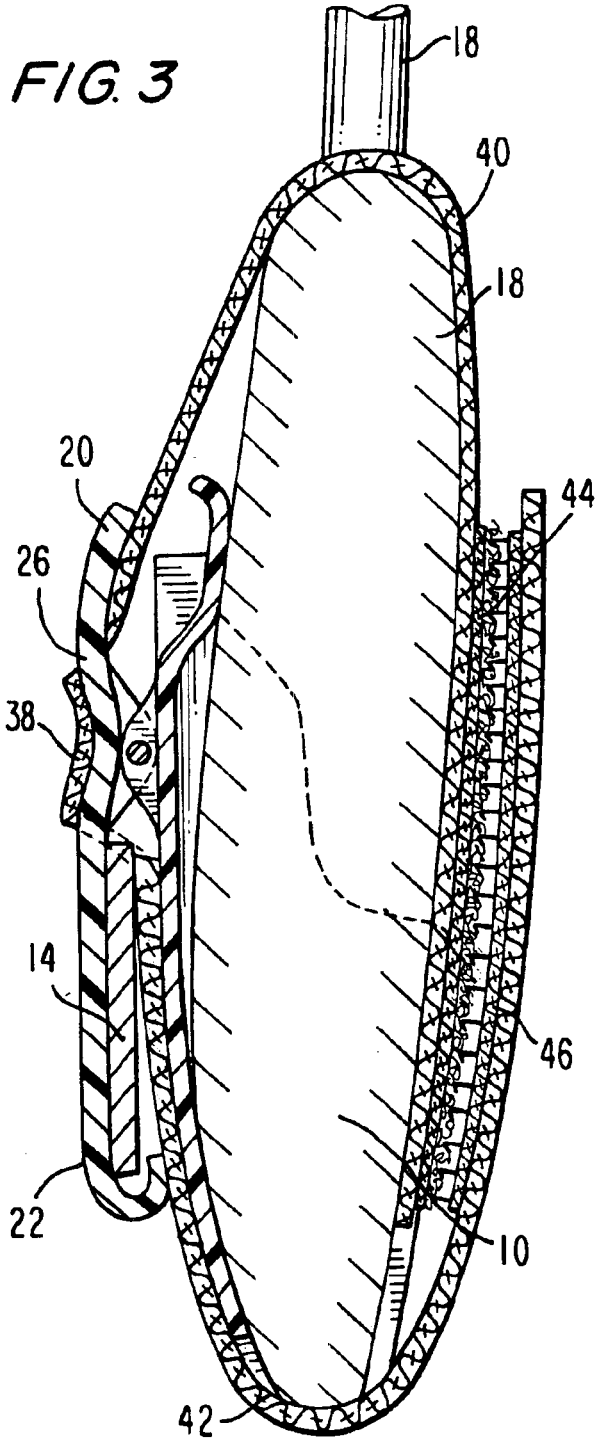
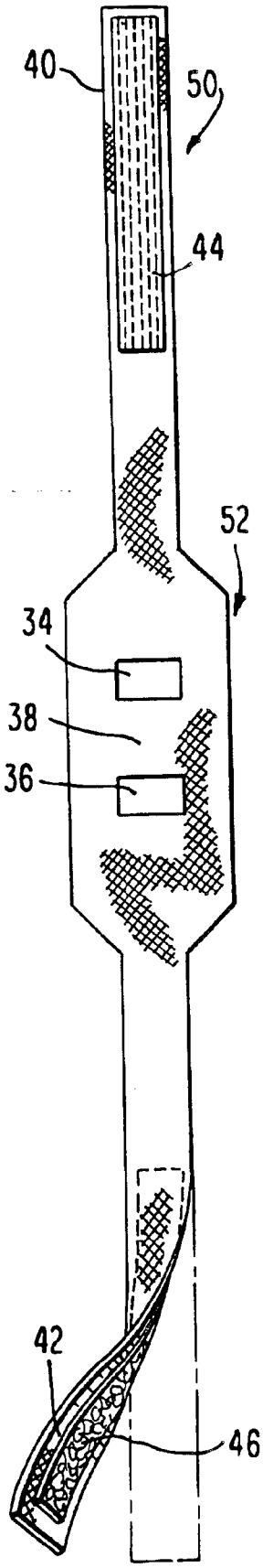
FIG. 4

CELL PHONE HOLSTER SUBSIDIARY STRAP AND HOLDER

BACKGROUND OF THE INVENTION

1. Field of the Invention

The present disclosure relates to cell phones, pagers, and holsters for retaining such cell phones and pagers, and in particular the present disclosure relates to a holder for holding such cell phones, pagers, and holsters.

2. Description of the Related Art

Cell phone and pager holsters are known, such as the example holster 10 shown in FIG. 1, which include a clip 12 for engaging and removably attaching the holster 10 to a belt 14 or the clothing of a user 16, and so permitting the cell phone 18 or pager to be removably positioned substantially adjacent to the body of the user 16. For example, the clip 12 includes a top portion 20, a bottom portion 22, and a hinge 24 therebetween, such that when the user 16 presses a surface 26 of the top portion 20 to move the top portion 20 towards the holster 10, the bottom portion 22 moves away from the holster 10, providing space between the bottom portion 22 and the holster 10 to slide the belt 14 or clothing within the space. The hinge 24 may be a spring-based hinge or a living hinge, to provide a restorative force to move the bottom portion 22 to be substantially adjacent to the holster 10, and so to removably position the holster 10 and clip 12 on the belt 14.

Alternatively, a clip similar to the clip 12 shown in FIG. 1 is attached and/or removably mounted directly onto the cell phone 18 or pager for securing the cell phone 18 or pager in a removable position substantially adjacent to the body of the user 16.

Holders and other devices are known which include a single aperture through which passes the clip 12 of a cell phone, a pager, or a holster holding a cell phone or pager, allowing the clip 12 to engage the belt 14 or clothing of the user 16. However, the weight or other forces, such as frictional forces, associated with the cell phone, pager, or holster, causes wear on and thus weakens the structure of the holder at the point of contact in the aperture between the clip 12 and the holder.

Typically, such holders are composed of fabric to be adaptable to different sizes of cell phone, pager, or holster, and to reduce costs. However, being composed of fabric, such fabric-composed holders are especially prone to the wear and weakening effects of the weight or other forces associated with the cell phone, pager, or holster.

A need exists for a holder, such as a fabric-composed holder, for holding a cell phone, pager, or holster, with the holder configured to distribute the weight or other forces, such as frictional forces, associated with the cell phone, pager, or holster, to counter the wear and weakening effects on the holder at the point of contact in the aperture between the clip 12 and the holder.

In addition, holders for cell phones, pagers, or holsters known in the art include a single aperture with the structurally weaker aspects described herein and/or are composed of rigid material, reducing the adaptability of the holder to diverse sizes of cell phones, pagers, and holsters, as opposed to a fabric-composed holder. In addition, such rigid-material-based holders or additional structures incorporated in known holders to counter the wear and weakening and to provide such rigidity increase the costs of manufacture of the holder.

A need exists for a holder for cell phones, pagers, or holsters which provides such weakness-countering structure while being relatively inexpensive to manufacture, for example, using fabric.

Furthermore, holders for cell phones, pagers, or holsters known in the art are open at one end, typically at a top end 28 as shown in the example holster 10 of FIG. 1, requiring the holder to be substantially vertical at all times; otherwise, the cell phones 18, pagers, or holsters positioned in such open ended holders are prone to slip out of the holder when the user bends over or otherwise changes position with the open end of the holder in a downward angle. When such cell phones, pagers, or holsters slip out, such devices may fall to the ground and be damaged with significant costs to repair or replace.

A need exists for holders for retaining cell phones, pagers, or holsters while allowing the holders and the cell phones, pagers, or holsters to be oriented in any angular direction without the danger of the cell phones, pagers, or holsters slipping out of the holder and being damaged.

BRIEF SUMMARY OF THE INVENTION

A holder retains cell phones, pagers, or holsters, with the holder composed of fabric; having a strap and optionally a pouch for retaining the held cell phones, pagers, or holsters in any angular orientation of the holder; and having a pair of apertures for engaging and retaining the clip of an associated cell phone, pager, or holster, with a strip positioned between the pair of apertures for engaging the clip and for distributing the weight and/or other forces associated with the clip and the associated cell phone, pager, or holster, and preventing wear on the holder.

BRIEF DESCRIPTION OF THE SEVERAL VIEWS OF THE DRAWINGS

FIG. 3 illustrates a side cross-section view of the holder of FIGS. 1–2 taken along lines 3—3.

FIG. 4 illustrates a front elevation view of a second embodiment of the holder with a wider intermediate portion and composed of flexible fabric.

DETAILED DESCRIPTION OF THE INVENTION

FIGS. 1–8 illustrate various embodiments of the disclosed holder for use in conjunction with and subsidiary to holsters for cell phones. The disclosed holder includes a flexible strap having a plurality of apertures with a strip of fabric therebetween, through which apertures is removably disposed the clip of a rigid standard-type cell phone holsters for retaining a cell phone.

The holder is flexible, being composed, for example, of fabric and/or other known materials, and the holder engages a cell phone holster by the cut-out portions adapted to receive a waist/belt gripping portion of a standard type holster, such as plastic holsters with clips adapted to removably mount the "MOTOROLA STARTAC" line of products to the belt or waist of the user.

Figure 1:
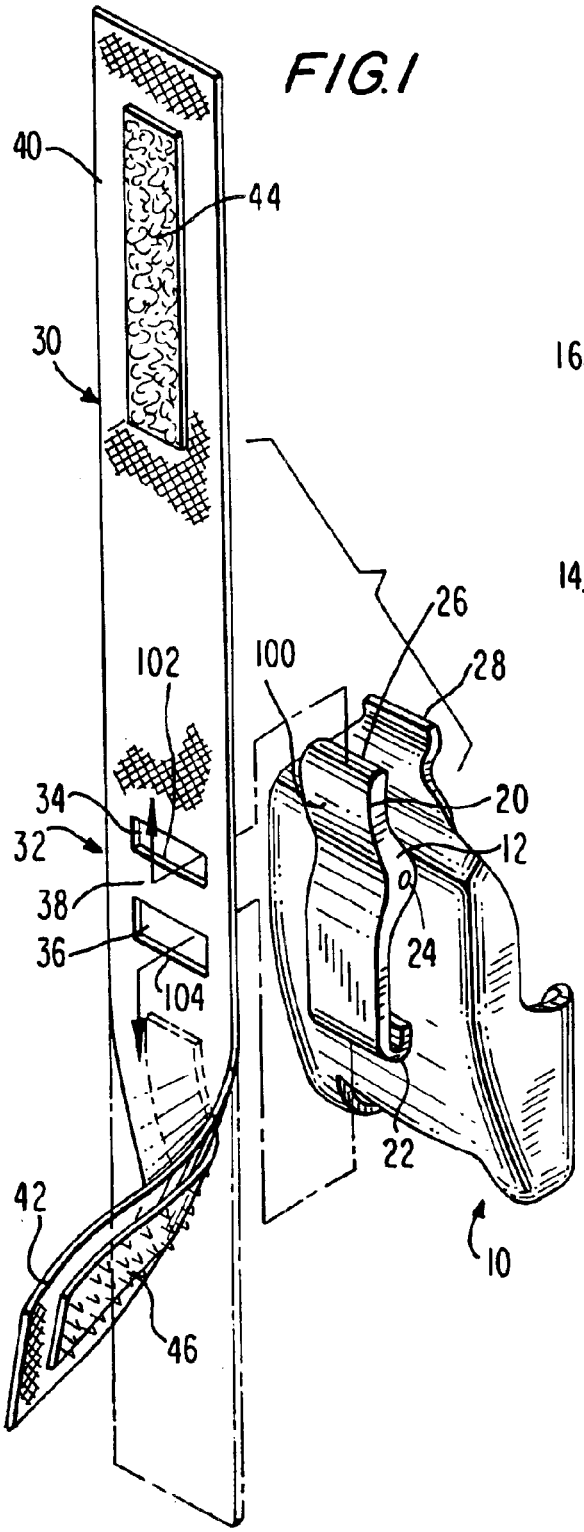
FIG. 1 illustrates a side perspective view of a first embodiment of the disclosed holder.
Figure 2:
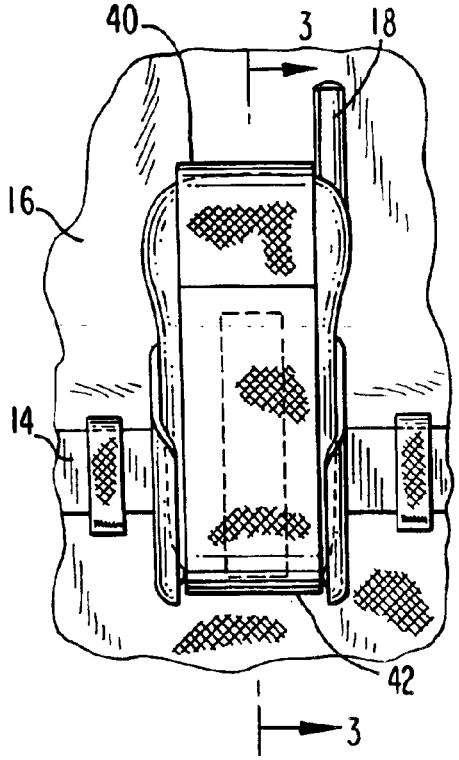
FIG. 2 illustrates a front elevation view of the holder of FIG. 1.

In a first embodiment shown in FIGS. 1–3, the holder 30 is composed of a fabric portion forming a first panel 32 having a plurality of cut-out portions 34, 36 or apertures through which passes a gripping clip 12, such as a pivotable clip, attached to the rear portion of the standard type holster 10. An intermediate strip 38 of fabric is disposed between the cut-out portions 34, 36 for engaging and frictionally holding the surface 26 of the top portion 20 of the clip 12, and for reducing overall wear on the cut-out portions 34, 36.

In the first embodiment, the holder 30 has a pair of elongated straps 40, 42 of flexible fabric extending from the top and bottom of the first panel 32, which may include hook-and-loop devices 44, 46, such as commercially available products known as "VELCRO", for being secured to each other and/or to a portion of "VELCRO" mounted on the cell phone 18 and/or the rigid standard-type cell phone holster 10. Thus, the pair of straps 40, 42 secure the cell phone 18 within the rigid standard-type cell phone holster 10, as shown in FIGS. 2–3, with the straps 40, 42 wrapped around the holster 10 and the cell phone 18 disposed in the holster 10.

FIG. 2 illustrates a front elevation view of the holder of FIG. 1, and FIG. 3 illustrates a side cross-section view of the holder of FIGS. 1–2 taken along lines 3—3, showing the holster 10 and the cell phone 18 in the wrapped configuration with the straps 40, 42. The combination of the clip 12 of the holster 10 and the holder 20 cooperate to hold the cell phone 18 or pager in place, since the clip 12 of the holster 10 serves to retain the holder 20 substantially adjacent to the body of the user 16, while the holder 20 serves to retain the cell phone 18 or pager in the holster 10.

In a second embodiment, shown in a front elevation view in FIG. 4, the holder 50 has a wider intermediate portion 52 as the first panel having the cut-out portions 34, 36, and the strip 32 of fabric, to hold the holster 10 and the clip 12 in the same manner as the holder 20 in FIGS. 1–3. The holder 50 may be composed of flexible fabric, with ends 40, 42 and hook-and-loop fasteners 44, 46 to be used in the same manner as the holder 20 of FIGS. 1–3.

Figure 5:
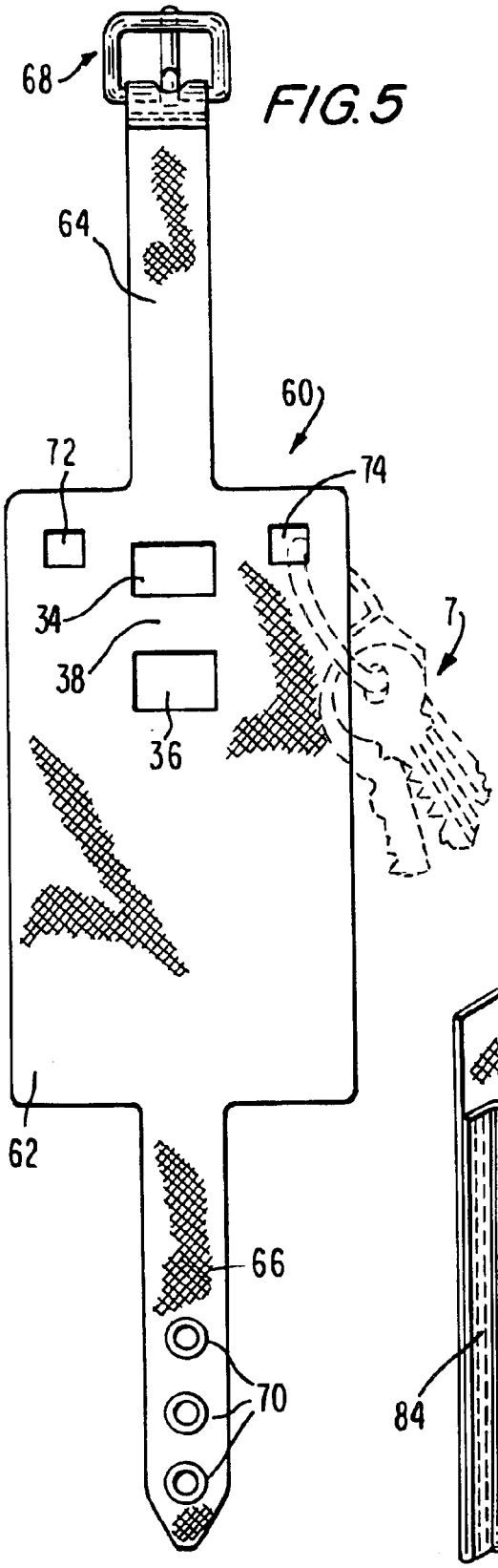
FIG. 5 illustrates a front elevation view of a third embodiment of the holder with a wider intermediate portion having accessory apertures for keychains and keyrings.

In a third embodiment, shown in a front elevation view in FIG. 5, the holder 60 has a wider intermediate portion 62 with the cut-out portions 34, 36 and the strip 38 of fabric, to hold the holster 10 and the clip 12 in the same manner as the holder 20 in FIGS. 1–3. The holder 60 may be composed of flexible fabric, with ends 64, 66 which may include hook-and-loop fasteners to be used in the same manner as the holder 20 of FIGS. 1–3.

Alternatively, the ends of the holders 20, 50, 60 may include any known fasteners for wrapping the ends of the holders 20, 50, 60 around the holster 10 and cell phone 12, and for securing the cell phone 12 in the holster 10 as described herein. For example, as shown in FIG. 5, the ends 64, 66 of the holder 60 may include a buckle 68 and apertures 70, respectively, to provide a buckle-and-aperture-type fastener configuration. Alternatively, configurations of a magnet and a magnetically attractable material may also be used as fasteners for the holders 20, 50, 60.

In the third embodiment shown in FIG. 5, the intermediate portion 62 also includes accessory apertures 72, 74 for retaining keychains and/or keyrings 76. For example, a keychain may be strung through both of the apertures 72, 74. In alternative embodiments, the belt 14 may be strung through the apertures 72, 74.

Figure 6:
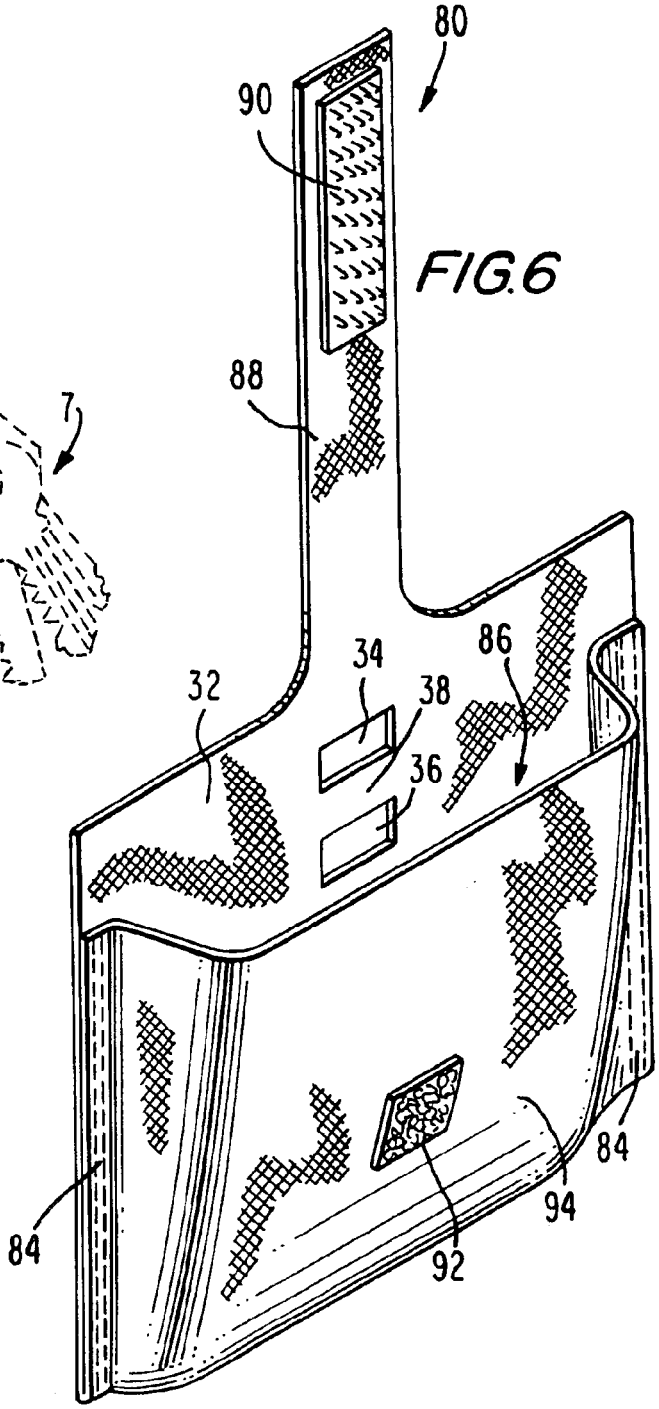
FIG. 6 illustrates a side perspective view of a fourth embodiment of the holder including a pouch.

In a fourth embodiment shown in FIG. 6, the holder 80 has a second panel 82 connected to the first panel 32, for example, by stitching 84, or alternatively by adhesives or heat sealing. The first panel 32 includes the cut-out portions 34, 36, and the strip 32 of fabric, to hold the holster 10 and the clip 12 in the same manner as the holder 20 in FIGS. 1–3.

The first panel 32 and the second panel 82 form a pouch 86 in which the rigid standard-type cell phone holster 10 is disposed. A single elongated strap 88 extends from the top of the first panel 32, which may be folded over the top of the cell phone 12 disposed in the standard type holster 10 to secure the cell phone 12 therein. The holder 80 may be composed of flexible fabric, with the single elongated strap 88 including hook-and-loop fasteners 90 for engaging complementary hook-and-loop fasteners 92 disposed on an outer surface 94 to be used in the same manner as the holder 20 of FIGS. 1–3. Alternatively, any known fasteners may be used with the holder 80 in the same manner as the holders 20, 50, 60, as described herein, such as buckle-and-aperture-type fastener configurations or magnet-based fasteners.

Figure 7:
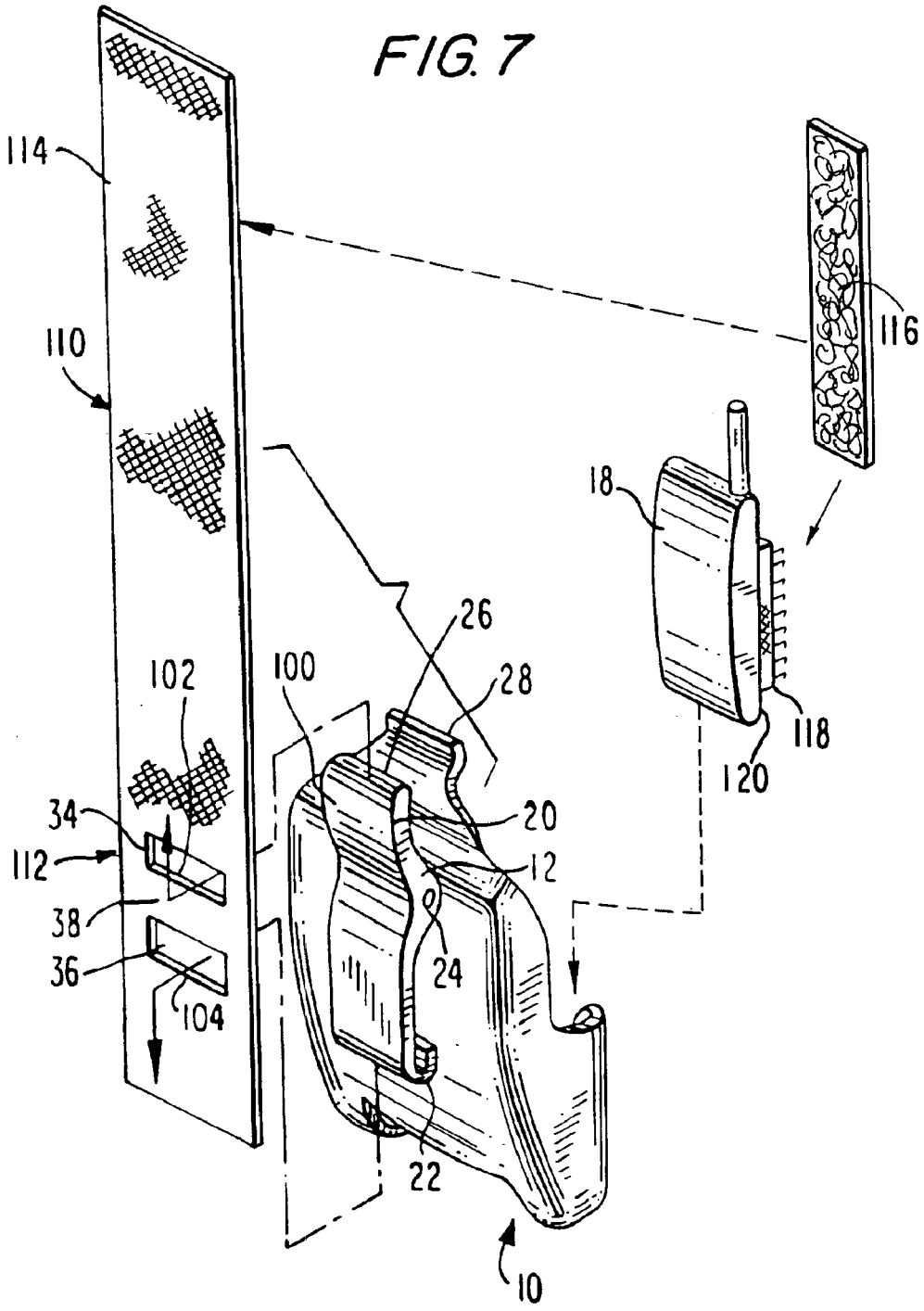
FIG. 7 illustrates a side perspective view of a fifth embodiment of the holder.
Figure 8:
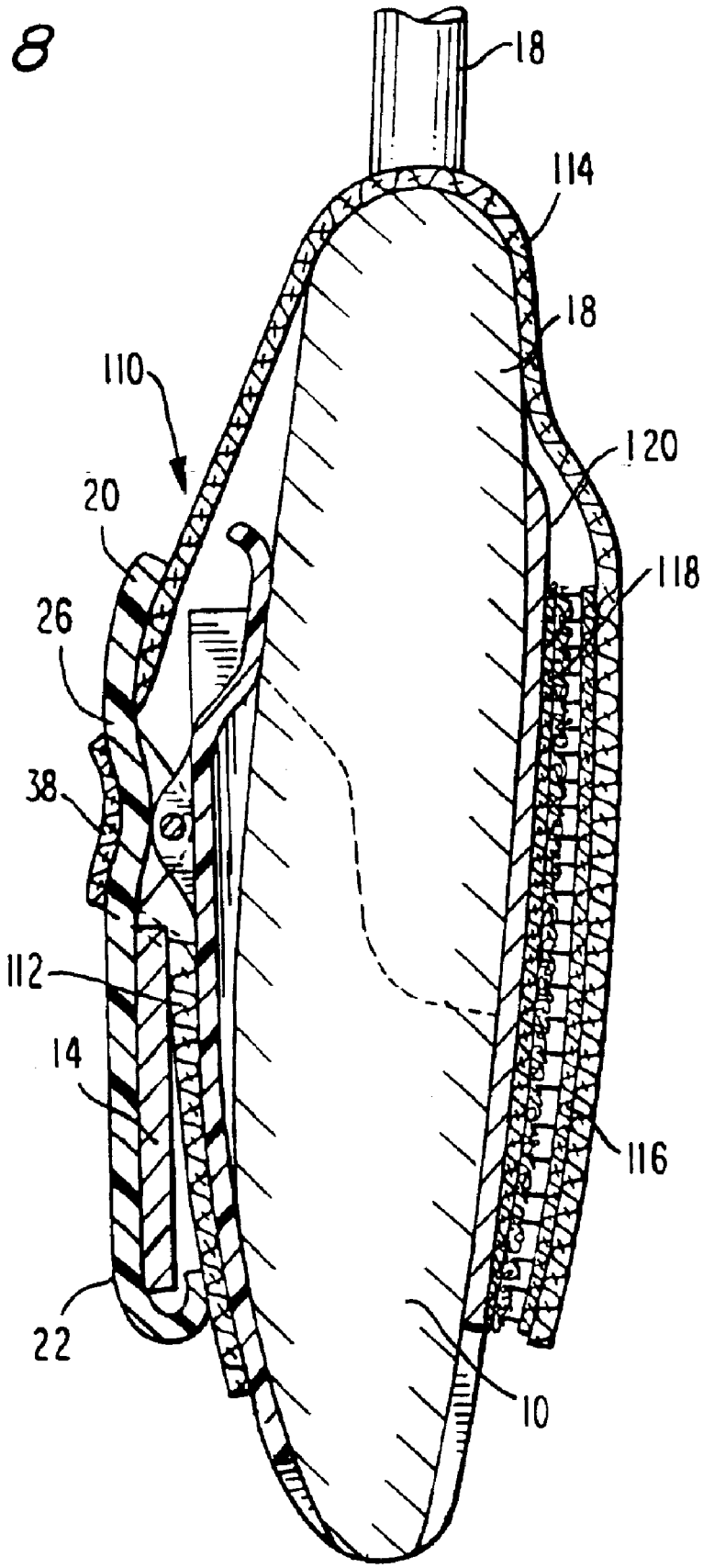
FIG. 8 illustrates a side cross-sectional view of the fifth embodiment of FIG. 7.

In a fifth embodiment, as shown in the side perspective view of FIG. 7, and the side cross-sectional view of FIG. 8, the holder 110 is composed of a fabric portion forming a first panel 112 having a plurality of cut-out portions 34, 36 or apertures through which passes a gripping clip 12, such as a pivotable clip, attached to the rear portion of the standard type holster 10. An intermediate strip 38 of fabric is disposed between the cut-out portions 34, 36 for engaging and frictionally holding the surface 26 of the top portion 20 of the clip 12, and for reducing overall wear on the cut-out portions 34, 36.

In the fifth embodiment, the holder 110 has an elongated strap 114 of flexible fabric extending from one end, such as the top, of the first panel 112, which may include a hook-and-loop device 116, such as commercially available products known as "VELCRO", for being secured to a portion 118 of "VELCRO" mounted on a surface 120 of the cell phone 18. Thus, the strap 114 secures the cell phone 18 within the rigid standard-type cell phone holster 10, as shown in FIG. 8, with the strap 114 wrapped around the holster 10 and the cell phone 18 disposed in the holster 10.

In all of the embodiments of the holders 20, 50, 60, 80, 110 shown in FIGS. 1–8, the holders include two cut-outs in the first panel: a lower cut-out portion 36 through which an elongated end 22 of the pivoting clip 12 may extend, and an upper cut-out portion 34 through which may protrude an exposed finger-grip end 26 of the pivoting clip 12, with an intermediate strip 38 of fabric between the cut-out portions 34, 36. The configuration of cut-out portions 34, 36 with intermediate strip 38 in the holder allows a user to directly press the exposed finger-grip end 26 without any intervening fabric of the flexible holder, allowing the standard type holster 10 to be readily removed.

The strip 38 of fabric between the upper cut-out portion 34 and lower cut-out portion 36 provides additional friction against the lower surface 100 of the finger-grip end 26, as shown for example, in FIG. 1, positioned in the upper cut-out portion 34, so the weight or other forces associated with the entire standard type holster 10, for example, from movement of the holster during walking action of the user 16, is distributed to different parts of the flexible holder.

Such weight or force distribution prevents the first panel 32 of the flexible holder from experiencing stress at any single point at the lower ends 102, 104 of the upper cutout portion 34 and lower cut-out portion 36, respectively, as shown in FIG. 1. Known holders having a single aperture or cut-out portion experience the stress at the lower end of the single aperture, and so experience excessive wear. The holders shown in FIGS. 1–6 having a pair of cut-out portions 34, 36 with the weight/force distributing intermediate strip 38 does not experience any excessive wear and ripping of the flexible holder and thus has a longer lifespan than expected compared to known cell phone, pager, or holster-holding devices lacking such an intermediate fabric strip 38.

Other advantages of the dual cut-out portions 34, 36 with intermediate fabric strip 38 may also be provided, such as adaptability for passing therethrough and optionally tying a strap or wire of the cell phone 18 and/or other types of cell phone holsters, instead of using a clip-type holster.

Alternatively, the user may optionally place the clip 12 only through a single one of the cut-out portions 34, 36. For example, only the bottom portion 22 of the clip 12 is slipped through and positioned in the lower cut-out portion 34 to directly engage and grasp the belt 14 or clothing of the user, and so the clip 12 and the holster 10 may be more easily removed from any of the holders 20, 50, 60, 80, 110 having the cut-out portion 34. In additional alternative embodiments, the holster 10 may include a hook instead of the clip 12, with the hook optionally being placed in only one of the pair of cut-out portions such as the lower cut out portion 34.

What is claimed is:

1. A holder for removably retaining a device substantially adjacent to the holder, with the device having a clip, the holder comprising:

a longitudinally extending portion of material for wrapping around the top and bottom of the device along a longitudinal length of the device, the longitudinally extending portion having a longitudinal axis and including:

a pair of apertures in the portion of material with the pair of apertures aligned substantially parallel to the longitudinal axis of the longitudinally extending portion and through which a pair of portions of the clip of the device aligned substantially parallel to the longitudinal axis of the longitudinally extending portion are removably disposed; and a strip of material disposed between the pair of longitudinally aligned apertures for distributing a force associated with the clip of the device, thereby reducing wear on the longitudinally extending material.

2. The holder of claim 1, further comprising:

an longitudinally extending end; and a pouch for retaining the device therein;

wherein the longitudinally extending end wraps around the device to be substantially adjacent to a surface of the pouch, thereby retaining the device within the pouch at any angular orientation and preventing the device from being removed from the holder.

3. The holder of claim 1, wherein the portion of material is composed of fabric.

4. The holder of claim 1, wherein the longitudinally extending portion of material wraps around a portion of the device, with the longitudinally extending portion of material including:

a first hook-and-loop fastening element for engaging a second hook-and-loop fastening element mounted on the device, thereby retaining the device within the wrapped configuration of the portion of material at any angular orientation and preventing the device from being removed from the holder.

5. The holder of claim 1, wherein the longitudinally extending portion of material wraps around the device, thereby retaining the device within the wrapped configuration of the portion of material at any angular orientation and preventing the device from being removed from the holder.

6. The holder of claim 5, further comprising:

a pair of ends of the longitudinally extending portion of material; and a fastener on at least one of the pair of ends for securing the pair of ends together to retain the longitudinally extending portion of material in the wrapped configuration about the device.

7. The holder of claim 6, wherein the fastener includes a hook-and-loop fastening element disposed on at least one of the pair of ends.

8. The holder of claim 6, wherein the fastener includes a buckle disposed on at least one of the pair of ends.

9. The holder of claim 1, wherein the longitudinally extending portion of material further includes:

a pair of ends having a first width; and an intermediate portion having:

the pair of apertures;

a second width greater than the first width.

10. The holder of claim 9, wherein the intermediate portion further includes:

accessory apertures for retaining an accessory.

11. The holder of claim 10, wherein the accessory is a keychain.

12. The holder of claim 10, wherein the accessory is a keyring for retaining keys.

13. A holder for removably retaining a device substantially adjacent to the holder, with the device having a clip, the holder comprising:

a longitudinally extending portion of material for wrapping around the top and bottom of the device along a longitudinal length of the device, the longitudinally extending portion having a longitudinal axis and including:

at least one aperture in the longitudinally extending portion of material through which the clip of the device is removably disposed with the clip of the device aligned substantially parallel to the longitudinal axis of the longitudinally extending portion.

14. The holder of claim 13, further comprising:

an longitudinally extending end; and a pouch for retaining the device therein;

wherein the longitudinally extending end wraps around the device to be substantially adjacent to a surface of the pouch, thereby retaining the device within the pouch at any angular orientation and preventing the device from being removed from the holder.

15. The holder of claim 13, wherein the longitudinally extending portion of material further includes:

a pair of ends having a first width; and an intermediate portion having:

the at least one aperture;

a second width greater than the first width.

16. The holder of claim 13, wherein the longitudinally extending portion of material wraps around a portion of the device, with the longitudinally extending portion of material including:

a first hook-and-loop fastening element for engaging a second hook-and-loop fastening element mounted on the device, thereby retaining the device within the wrapped configuration of the portion of material at any angular orientation and preventing the device from being removed from the holder.

17. The holder of claim 13, wherein the longitudinally extending portion of material wraps around the device, thereby retaining the device within the wrapped configuration of the portion of material at any angular orientation and preventing the device from being removed from the holder.

18. The holder of claim 17, further comprising:

a pair of ends of the longitudinally extending portion of material; and a fastener on at least one of the pair of ends for securing the pair of ends together to retain the longitudinally extending portion of material in the wrapped configuration about the device.

19. The holder of claim 18, wherein the fastener includes a hook-and-loop fastening element disposed on at least one of the pair of ends.

20. The holder of claim 18, wherein the fastener includes a buckle disposed on at least one of the pair of ends.

* * * * *